US010508247B2

(12) United States Patent
Tian et al.

(10) Patent No.: US 10,508,247 B2
(45) Date of Patent: Dec. 17, 2019

(54) PROCESS OF MAXIMIZING PRODUCTION OF CHEMICAL RAW MATERIALS BY GASEOUS PHASE CATALYTIC CRACKING CRUDE OIL WITH MULTI-STAGES IN MILLISECONDS IN COMBINATION WITH HYDROGENATION

(71) Applicant: China University of Petroleum (East China), Qingdao (CN)

(72) Inventors: Yuanyu Tian, Qingdao (CN); Yingyun Qiao, Qingdao (CN); Juntao Zhang, Qingdao (CN); Jinhong Zhang, Qindao (CN); Yuan Jiang, Qingdao (CN); Jie Li, Qingdao (CN)

(73) Assignee: CHINA UNIVERSITY OF PETROLEUM (EAST CHINA), Qingdao (CN)

( * ) Notice: Subject to any disclaimer, the term of this patent is extended or adjusted under 35 U.S.C. 154(b) by 0 days.

(21) Appl. No.: 16/386,872

(22) Filed: Apr. 17, 2019

(65) Prior Publication Data

US 2019/0316049 A1 Oct. 17, 2019

(30) Foreign Application Priority Data

Apr. 17, 2018 (CN) ..... 2018 1 0341186

(51) Int. Cl.

*C10G 9/28* (2006.01)
*C10G 51/04* (2006.01)
*C10G 67/02* (2006.01)

(52) U.S. Cl.

CPC ..... *C10G 67/02* (2013.01); *C10G 2300/302* (2013.01); *C10G 2400/02* (2013.01); *C10G 2400/04* (2013.01); *C10G 2400/06* (2013.01); *C10G 2400/20* (2013.01)

(58) Field of Classification Search

CPC ..... C10G 9/28; C10G 51/04
See application file for complete search history.

(56) References Cited

U.S. PATENT DOCUMENTS 5,523,502 A * 6/1996 Rubin ..... C07C 11/04 568/697
5,670,037 A 9/1997 Zaiting et al.
6,210,562 B1 * 4/2001 Xie ..... B01J 38/06 208/118
8,877,042 B2 * 11/2014 Dean ..... C10G 11/18 208/113

FOREIGN PATENT DOCUMENTS

CN 102965139 A 3/2013
CN 104245890 A 12/2014
CN 105602628 A 5/2016
CN 105969417 A 9/2016
CN 106939171 A 7/2017
CN 109628154 A 4/2019
CN 109790474 A 5/2019

OTHER PUBLICATIONS

Tang, R. et al. "Preparation of Ca Based Solid Base Catalyst and Its Cracking Gasification Performance for Heavy Oil" (2016) ACTA Petrolei Sinica 32(3): 486-492.
Zhang et al. "High Temperature Millisecond Pyrolysis of Residue" (2016) International Conference on Civil, Transportation and Environment (ICCTE), Atlantis Press: 1222-1225.

* cited by examiner

*Primary Examiner* — Randy Boyer
(74) *Attorney, Agent, or Firm* — Volpe and Koenig, P.C.

(57) ABSTRACT

The invention provides a process of maximizing production of chemical raw materials by gaseous phase catalytic cracking crude oil with multi-stages in milliseconds in combination with hydrogenation, comprising: a high-efficiency atomizing nozzle sprays the preheated crude oil into an upper portion of the downflow modification reaction tube, the produced oil mist is mixed with a high temperature heat carrier flowing downward from a first return controller for pyrolysis in milliseconds and then the pyrolysis products are subject to a gas-solid separation; the coked heat carrier obtained by the separation enters into a modification regeneration reactor to conduct a regeneration reaction, the obtained high temperature heat carrier returns to a top of the downflow reaction tube to participate in circulation, the regeneration gas is subject to heat exchange and then output; the high temperature oil and gas produced by the pyrolysis reaction directly flow into the millisecond cracking reactor and conduct a cracking reaction with the regenerated cracking catalyst and subject to a gas-solid separation; then the cracking catalyst to be regenerated enters the crack regeneration reactor and performs a regeneration reaction and then are subject to a gas-solid separation, the obtained high temperature crack catalyst passes through a second return controller and flows into the millisecond cracking reactor to participate the circulation reaction, the obtained flue gas is subject to heat exchange and then output; the cracked oil and gas produced by the cracking reaction enter into a fractionation tower for separation, thereby obtain the cracked gas, gasoline fraction, diesel fraction, recycle oil and oil slurry; furthermore, the diesel fraction, recycle oil and oil slurry are subject to saturation or open-ring in a hydrogenation reactor, return and mix with crude oil such that the mixture is used as a raw material.

13 Claims, 1 Drawing Sheet

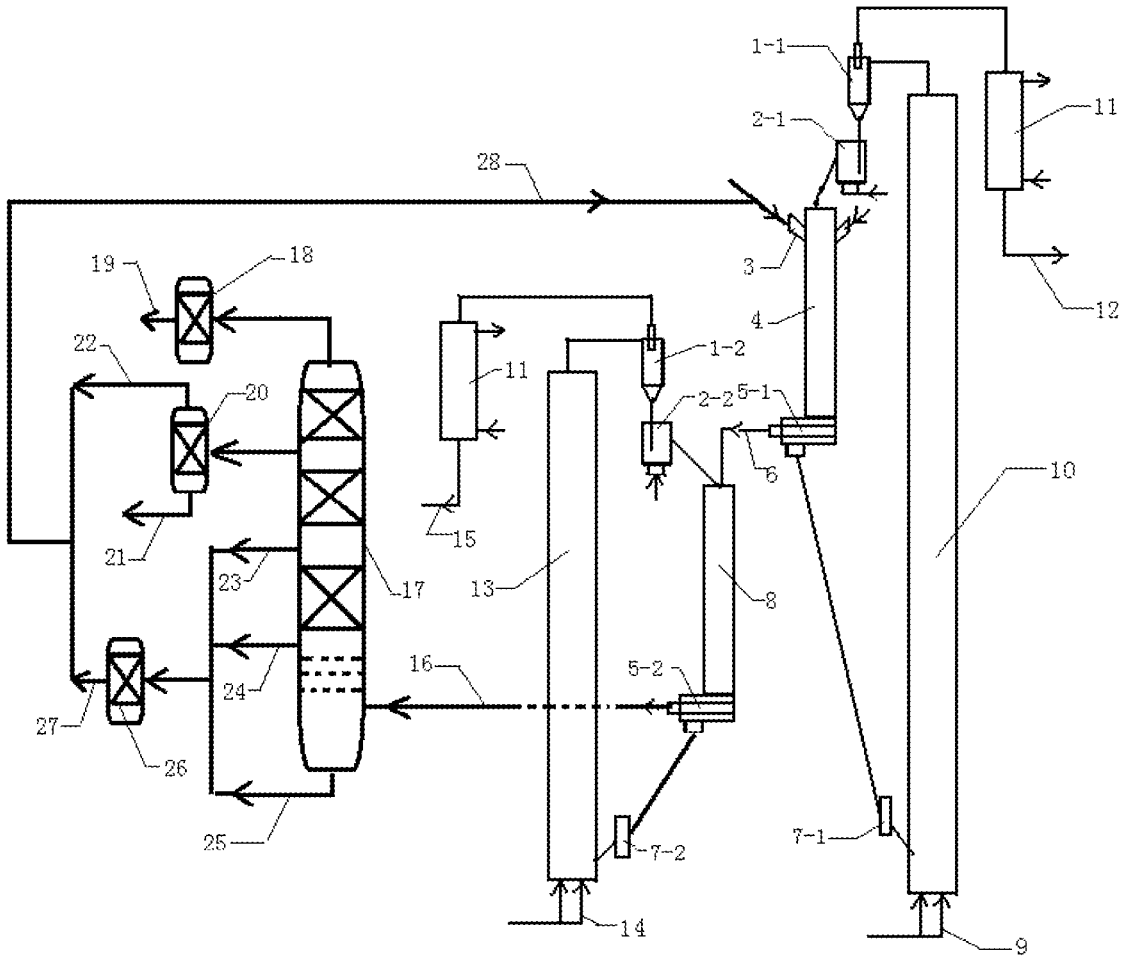
1-1
2-1
11
28
3
12
4
19
18
22
20
1-2
11
2-2
5-1
6
10
21
15
23
17
13
8
16
5-2
24
27
26
25
7-2
7-1
14
9

PROCESS OF MAXIMIZING PRODUCTION OF CHEMICAL RAW MATERIALS BY GASEOUS PHASE CATALYTIC CRACKING CRUDE OIL WITH MULTI-STAGES IN MILLISECONDS IN COMBINATION WITH HYDROGENATION

CROSS REFERENCE TO RELATED APPLICATIONS

The application claims priority to Chinese Application No. 201810341186.5, filed on Apr. 17, 2018, entitled "Process of Maximizing Production of Chemical Raw Materials by Gaseous Phase Catalytic Cracking Crude Oil with Multi-stages in Milliseconds in Combination with Hydrogenation", which is specifically and entirely incorporated herein by reference.

FIELD OF THE INVENTION

The invention provides a process of maximizing production of chemical raw materials by gaseous phase catalytic cracking crude oil with multi-stages in milliseconds in combination with hydrogenation, it belongs to the technical field of petroleum processing.

BACKGROUND OF THE INVENTION

The three olefins (i.e., "ethylene, propylene and butane") and three aromatic hydrocarbons (i.e., "benzene, toluene, xylene") are vital basic organic chemical materials, especially the production capability of ethylene is often regarded as a symbol of the development level of petrochemical industry in a country and region. Due to the explosive development of energy storage battery technologies and the imminent implementation of the "National VI" vehicle exhaust emission standards in the People's Republic of China (PRC), which is so-called the world's most stringent standards for vehicle exhaust emission, the electric vehicles have emerged as the rising alternative of the fuel oil vehicles by virtue of the advantages such as the near zero pollution during the driving process, energy saving, low cost of use and may be easily intelligentized, it has become an irreversible development trend that the fuel oil vehicles will be replaced by the electric vehicles, the subsequent result will be a sharp decline of the oil consumption in the transportation industry, thus it is urgent for the petroleum processing enterprises to transform its production mode from "fuel oil dominated pattern" to "chemical products dominated pattern".

At present, about 95% of ethylene and 66% of propylene in the world are produced by a tube furnace steam pyrolysis process using light weight raw materials such as natural gas, naphtha or light diesel oil. However, in view of the gradual depletion of conventional crude oil resources since the 21$^{st}$ century, the crude oil supply in the world has presented the development trends of heavy weight and inferior quality, leading to a relative deficiency of light weight cracking raw materials, while the worldwide market demand for low-carbon olefins is growing rapidly. In order to alleviate the imbalance between the supply and demand, broaden the raw materials for producing the low-carbon olefins, and make better use of heavy feedstock oil, the development of "chemical products dominated pattern" technical routes that use heavy oil as a raw material to directly produce low-carbon olefins through catalytic cracking process has become the focus and hotspot of research in the petroleum refining industry at home and abroad, however, there are very few mature technologies that can be industrialized.

Many technologies of catalytic cracking heavy oil for producing low-carbon olefins have been developed in recent years, and have attracted the widespread interest and demonstration applications in the industry, for example, the DCC/CPP process developed by the Sinopec Research Institute of Petroleum Processing; the PetroFCC process developed by the Universal Oil Products (UOP) Company in the Unites States of America (USA); the High Severity Fluidized Catalytic Cracking (HS-FCC) process and the THR technology developed by the Japan Petroleum Energy Center (JPEC); the TCSC process developed by the German Institute of Organic Chemistry; the INDMAX (UCC) process developed by the Indian Oil Corporation (IOC), the Maxofin process jointly developed by the Exxon Mobil and the Kellog, and the two-stage riser catalytic cracking (TMP) process proposed by China University of Petroleum (CUP). Compared with steam cracking process, the technologies of catalytic cracking heavy oil for producing low-carbon olefins have the advantages such as widened feedstock ranges of olefins, low reaction temperature, easy adjustment of the product distribution, and low energy consumption. On the one hand, these catalytic cracking processes should adopt the operation modes with high temperature, short residence time, large catalyst/oil ratio and water/oil ratio. On the other hand, both the composition of raw materials and the properties of catalyst are key factors affecting the yield and distribution of the catalytic cracking products during the catalytic cracking operation process. However, the active components of the shape selective catalyst for heavy oil catalytic cracking are mainly ZSM-5 and Y-type molecular sieves, whose pore structures have a small size, so the diffusion of large heavy oil molecules are limited during the mass transfer process, and it is difficult for the large heavy oil molecules to enter into the molecular sieves to conduct a shape-selective cracking; moreover, the acidic molecular sieves have a strong hydrogen transfer performance, which leads to a limited increase in the yield and selectivity of the olefins. In addition, the heavy oil macromolecules accumulated on the surface of molecular sieves are prone to over-cracking under the action of the acid site, resulting in poor product distribution or coking and condensation, thereby blocking the pore channels of catalyst. At present, the existing industrial shape selective catalysts are used to prepare low-carbon olefins through catalytic cracking of the inferior materials such as atmospheric pressure residue oil, vacuum residue oil, deasphalted oil, which often leads to many problems such as catalyst poisoning, poor atomization effect, large amount of generated coke, and significantly lowered conversion rate and selectivity.

In addition, during the existing process of petroleum thermal processing, the hydrocarbon reaction mainly occurs in the form of liquid phase reaction. In the gaseous phase, hydrocarbon molecules can be quickly dispersed after being split into free radicals, while the free radicals in the liquid phase are surrounded by neighboring molecules which resemble a "cage", and the condensation polymerization will be intensified. In order to disperse the formed free radicals, it is necessary to overcome the additional potential barrier so as to diffuse out of the "cage", which is the so-called "cage effect". Such a "cage effect" may alter the activation energy and reaction rate of the liquid phase reaction relative to the gaseous phase reaction.

The process of directly preparing basic chemical raw materials from crude oil will significantly shorten the petroleum refining process, eliminate the processes such as atmospheric and vacuum distillation and coking, and will greatly reducing the energy consumption of processing. However, how to eliminate the pollution of residual carbon and heavy metal in the crude oil and maximize the acquired amount of three olefins and three aromatic hydrocarbons have emerged as a major issue which shall be urgently resolved in the transformation and upgrading process of processing petroleum with "chemical products dominated pattern" in the world.

SUMMARY OF THE INVENTION

In order to overcome the shortcomings of the existing technology of processing crude oil with "chemical products dominated pattern", an object of the invention is to develop a process of maximizing production of chemical raw materials by gaseous phase catalytic cracking crude oil with multi-stages in milliseconds in combination with hydrogenation, which may significantly improve the yield and selectivity of three olefins and three aromatic hydrocarbons, overcome the "cage effect" of the liquid phase reaction, reduce an influence of heat and mass transfer on catalytic cracking, and drastically decrease the amount of generated coke and energy consumption in the cracking process, and maximize utilization of the crude oil resources.

The process adopted by the invention utilizes millisecond pyrolysis of crude oil in the downflow pipe to maximize production of the oil and gas, this high temperature oil and gas is used for preparing low carbon olefins by directly subjecting to high temperature millisecond shape selective catalytic cracking instead of subjecting to the condensation and separation, and the diesel fraction, recycle oil and oil slurry produced by the shape selective catalytic cracking are subject to hydrogenation for saturation and open-ring and then reused as the raw materials with the crude oil, thereby fully utilizing heat of the pyrolysis oil and gas, significantly improving the yield and selectivity of three olefins and three aromatic hydrocarbons, overcoming the "cage effect" of the liquid phase reaction, reducing an influence of heat and mass transfer on catalytic cracking, and greatly decreasing the amount of generated coke and energy consumption in the cracking process, consequently achieving maximization of the crude oil resources and the high-yield and efficient production of the basic chemical raw materials.

The invention provides a process of maximizing production of chemical raw materials by gaseous phase catalytic cracking crude oil with multi-stages in milliseconds in combination with hydrogenation, it is characterized in that:

1) a high-efficiency atomizing nozzle sprays crude oil preheated to 150° C.-350° C. from a feed inlet of a downflow modification reaction tube into an upper portion of the downflow modification reaction tube, the produced oil mist is mixed with a high temperature solid heat carrier at a temperature ranging from 650° C.-1,200° C. flowing downward from a first return controller for milliseconds, so as to heat, vaporize and pyrolyze the oil mist and obtain an oil and gas and a solid heat carrier to be regenerated, the pyrolysis reaction temperature is within a range of 480° C.-850° C.;

2) the oil and gas as well as the solid heat carrier to be regenerated flow rapidly and downward to a first rapid gas-solid separator at the bottom of the downflow modification reaction tube to carry out a gas-solid separation;

3-1) the coked solid heat carrier to be regenerated flows through a first flow controller and enters into a lower portion of a modification regeneration reactor to conduct a regeneration reaction with a regeneration agent, the temperature of the regeneration reaction is within a range of 680° C.-1,250° C.; then the regeneration gas and high temperature solid heat carrier produced by the regeneration reaction are subject to a gas-solid separation in a first gas-solid separator on top of the modification regeneration reactor, then the high temperature solid heat carrier with a carrier/oil ratio of 1-14 passes through the first return controller and flows into a top of the downflow modification reaction tube and enter into the downflow modification reaction tube so as to participate in circulation and cracking of the heavy oil; while the regeneration gas from the first gas-solid separator is subject to heat exchange and then output; 3-2) the high temperature oil and gas from the first rapid gas-solid separator is not condensed but directly flowing in the gaseous phase into a millisecond cracking reactor and mixing with a regeneration cracking catalyst having a temperature of 600° C.-850° C. to carry out a gaseous phase catalytic cracking reaction, the temperature of cracking reaction temperature is within a range of 530° C.-750° C., then a cracking gas and a cracking catalyst to be regenerated produced by the cracking reaction are subject to gas-solid separation in milliseconds;

4-1) the cracking catalyst to be regenerated flows through a second flow controller and enters a lower portion of the crack regeneration reactor for performing a regeneration reaction with air, the temperature of the regeneration reaction is 630° C.-900° C., a flue gas and a high temperature crack catalyst produced in this regeneration reaction are subject to a gas-solid separation in a second gas-solid separator at the top of the crack regeneration reactor; the high temperature crack catalyst with a catalyst/oil ratio of 1-8 passes through a second return controller and flows into the millisecond cracking reactor to participate the circulation reaction; while the flue gas is subject to heat exchange and then output;

4-2) the cracking oil and gas produced by the cracking reaction enter into a catalytic fractionation tower and are separated into different fraction products, which are cracking gas, gasoline fraction, diesel fraction, recycle oil and oil slurry;

5-1) the cracked gas is separated for producing low-carbon olefins such as "ethylene, propylene and butene", 5-2) the gasoline fraction is extracted and separated for obtaining low-carbon aromatic hydrocarbons such as "benzene, toluene and xylene" and a gasoline fraction raffinate oil;

5-3) the diesel fraction is mixed with the recycle oil and the oil slurry to carry out catalytic saturation or open-ring reaction with a hydrogenation catalyst to obtain a hydrogenated modified oil, and then returns along with the gasoline fraction raffinate oil to mix with the crude oil and uses the mixture as a raw material which enters the upper portion of the downflow modification reaction tube for performing pyrolysis modification.

In the present invention, the involved term "millisecond" generally refers to a time of 600 ms or less.

Specifically, the used term "mixing . . . in milliseconds" refers to the mixing time below 600 ms.

The used term "millisecond cracking reactor" means a crack reactor having a reaction time less than 600 ms.

The used term "gas-solid separation in milliseconds" refers to that the gas-solid separation time below 600 ms.

In the present invention, the term "carrier/oil ratio" refers to the weight ratio of the used amount of solid heat carrier to the used amount of crude oil. When the numerical value of the "carrier/oil ratio" is less than 1, it may likely result in that the heat supply is insufficient, the reaction temperature is excessively low, and the crude oil cannot be completely converted into high temperature oil and gas in gaseous phase, which affects the overall yields of three olefins and three aromatic hydrocarbons of the device. While the numerical value of the "carrier/oil ratio" is greater than 14, it may easily cause that the heat supply is excessive, the crude oil is excessively cracked, the amount of generated coke is increased, the pyrolysis dry gas is increased, and the olefin selectivity of the subsequent reaction is deteriorated.

In the invention, the used term "catalyst/oil ratio" refers to the weight ratio of the used amount of cracking catalyst to the used amount of crude oil. When the numerical value of the "catalyst/oil ratio" is less than 1, it may result in that the heat supply is insufficient, the reaction temperature is excessively low, and the high temperature oil and gas in gaseous phase cannot be completely cracked, which affects the overall yields of three olefins and three aromatic hydrocarbons of the device. However, while the numerical value of the "catalyst/oil ratio" is greater than 8, it may easily cause that the heat supply is excessive, the high temperature oil and gas in gaseous phase is excessively cracked, the cracking dry gas is increased, and the selectivity of olefins is deteriorated.

In the present invention, the expression "modification" used in the term "downflow modification reaction tube" refers to a process in which the heavy metals, asphalt, sulfur and nitrogen are removed from the crude oil, and the purified crude oil is converted to the high temperature oil and gas in gaseous phase. Correspondingly, the term "modification regeneration reactor" refers to a reactor involving regeneration of coke carrier obtained by a process in which the heavy metals, asphalt, sulfur and nitrogen are removed from the crude oil, and the purified crude oil is converted to the high temperature oil and gas in gaseous phase.

In order to describe the present invention more clearly, the terms "rapid gas-solid separator" and "gas-solid separator" are used, their difference resides in that the rapid gas-solid separator has a separation time less than that of the gas-solid separator. For example, the separation time of the rapid gas-solid separator is less than ⅓ of the gas-solid separation time.

In the present invention, the crude oil may be one of the heavy oil, coal tar, shale oil and oil sand bitumen, all of them may be commercially available. The heavy oil may be one of the vacuum residue oil, atmospheric pressure residue oil and distillate.

In the invention, the regenerant agent is an oxidizing agent or a mixture of an oxidizing agent and water vapor, wherein the oxidizing agent is one of oxygen, air and oxygen-enriched air; and the regeneration gas is syngas or flue gas. Generally, the mixture of the oxidizing agent and water vapor may have a water vapor content of 10-40% by weight.

In the invention, the solid heat carrier is one of semi-coke microspheres, calcium aluminate porous microspheres, magnesium aluminate spinel porous microspheres, aluminum silicate porous microspheres, calcium silicate porous microspheres, magnesium silicate porous microspheres, porous microsphere carriers loaded with alkali metals or/and alkaline-earth metals or a mixture thereof.

In the present invention, the first gas-solid separator and the second gas-solid separator may be identical or different, and they may be one independently selected from the group consisting of an inertial separator, a horizontal cyclone separator, and a vertical cyclone.

In the invention, the first rapid gas-solid separator and the second gas-solid separator may be identical or different, and they may be one independently selected an inertial separator and a horizontal cyclone separator.

In the present invention, the cracking catalyst is one of a FCC molecular sieve catalyst, a shape selective molecular sieve catalyst such as ZSM-5 molecular sieve catalyst, and an alkaline solid porous catalyst or a mixture thereof.

In the invention, the modification regeneration reactor is one selected from a group consisting of a riser regenerator, a turbulent fluidized bed regenerator and a bubbling fluidized bed regenerator.

In the present invention, the crack regeneration reactor is one selected from a group consisting of a riser regenerator, a turbulent fluidized bed regenerator and a bubbling fluidized bed regenerator.

In the invention, the millisecond cracking reactor is one selected from a group consisting of a downflow tube reactor, a horizontal inertia rotary separation reactor and a cross-staggered short contact reactor.

In the present invention, the diesel fraction is mixed with the recycle oil and the oil slurry and then the mixture is subject to catalytic saturation and open-ring reaction with hydrogenation catalyst in the hydrogenation reactor, its effect resides in converting the polycyclic aromatic hydrocarbons included in this mixture, which are difficult to be cracked and may be easily coked, into paraffins which can be easily cracked; that is, if the mixture is directly mixed with crude oil for pyrolysis without performing saturation or open-ring reaction, it may cause a lowered yield of three olefins, an increased amount of generated coke, thereby affecting the economic benefit of the apparatus.

The hydrogenation catalyst is a composite catalyst of a nickel-based hydrogenation catalyst and a molecular sieve catalyst. A mass ratio of the nickel-based hydrogenation catalyst to the molecular sieve catalyst may be 1-4:1. The nickel-based hydrogenation catalyst may be specifically a supported catalyst containing active nickel, nickel molybdenum or nickel phosphorus, and the molecular sieve catalyst may be specifically a 4 A molecular sieve catalyst or a ZSM-5 catalyst.

The operating conditions of the saturation or open-ring reaction include a hydrogenation reaction temperature of 320-420° C. and a pressure ranging from 3.5-12.5 MPa.

The invention provides a process of maximizing production of chemical raw materials by gaseous phase catalytic cracking crude oil with multi-stages in milliseconds in combination with hydrogenation, the process utilizes a rapid alkaline catalytic pyrolysis of the inferior crude oil to maximize production of the oil and gas, this high temperature oil and gas is used for preparing low carbon olefins by directly subjecting to high temperature millisecond shape selective catalytic cracking instead of subjecting to the condensation and separation, thereby fully utilizing heat of the pyrolysis oil and gas, overcoming the "cage effect" of the liquid phase reaction, reducing an influence of heat and mass transfer on catalytic cracking, and significantly decreasing the amount of generated coke and energy consumption in the cracking process; the reaction temperature and time may be easily adjusted and controlled, and the characteristic that the alkaline catalytic pyrolysis of crude oil produces a large amount of olefins may be used for shape selective catalysis, thereby significantly increasing the yield and selectivity of low carbon olefins. For example, the process has a total yield of three olefins (i.e., "ethylene, propylene and butane") up to 50% for inferior heavy oil having a residual carbon content of 15%, wherein the yields of propylene and ethylene are 28% and 15%, respectively; the total yield of three olefins is much higher than about 35% of the total yield of three olefins from pyrolysis and catalytic cracking of wax oil; the process avoids the reheating, temperature rise and pulverization of the wax oil in the traditional combined process of pyrolysis modification—wax oil catalytic cracking, but it still has a common problem, namely the "cage effect" of the liquid phase reaction results in an increased condensation polymerization, thereby reducing the yield and selectivity of low carbon olefins. In addition, the process has a short processing procedure, the steel consumption of the apparatus is low, the fixed investment is greatly reduced; the atmospheric pressure operation is simple, it is convenient to start or shut down the apparatus, the operational continuity is desirable, and the apparatus has strong adaptability for processing a variety of oils.

Moreover, as compared with the direct refining of the diesel fraction, recycle oil and the oil slurry as the raw material to be pyrolyzed, the present invention defines that the diesel fraction, the recycle oil and the oil slurry are subject to hydrogenation for saturation, and returns along with the gasoline fraction and are used as the raw materials such that the yield of three olefins (i.e., "ethylene, propylene and butane") is increased by 3-10 percentage point.

The features of the present invention will be described in detail with reference to the specific embodiments.

BRIEF DESCRIPTION OF DRAWINGS

FIG. 1 is a schematic diagram of a technological process in the invention.

DESCRIPTION OF THE REFERENCE SIGNS

1-1. first gas-solid separator;
2-1. first return controller;
3. high-efficiency atomizing nozzle;
4. downflow modification reaction tube;
5-1. first rapid gas-solid separator;
6. pyrolysis gas outlet;
7-1. first flow controller;
8. millisecond cracking reactor;
1-2. second gas-solid separator;
2-2. second return controller;
5-2. second rapid gas-solid separator;
7-2. second flow controller;
9. regenerant inlet;
10. modification regeneration reactor;
11. heat exchanger;
12. regeneration gas outlet;
13. crack regeneration reactor;
14. air inlet;
15. flue gas outlet;
16. cracked oil and gas outlet;
17. catalytic fractionation tower;
18. olefin separation tower group;
19. low-carbon olefin outlet;
20. aromatic hydrocarbon extraction tower group;
21. low-carbon aromatic hydrocarbon outlet;
22. gasoline raffinate outlet;
23. diesel fraction outlet;
24. recycle oil outlet;
25. oil slurry outlet;
26. hydrogenation reactor;
27. hydrogenated modified oil outlet;
28. return oil line.

The technological characteristics of the present invention will be described in detail below with reference to FIG. 1 and the embodiment examples.

DETAILED DESCRIPTION OF THE EMBODIMENTS

Each of the following examples specifies a process for producing low-carbon olefins by gaseous phase catalytic cracking of crude oil with multi-stages in milliseconds according to the flow diagram shown in FIG. 1. The flow diagram shown in FIG. 1 specifically comprises:

1) a high-efficiency atomizing nozzle 3 sprays heavy oil preheated to 150° C.-350° C. from a feed inlet of a downflow modification reaction tube 4 into an upper portion of the downflow modification reaction tube 4, the produced oil mist is mixed with a high temperature solid heat carrier at a temperature ranging from 650° C.-1,200° C. flowing downward from a first return controller 2-1 for milliseconds, so as to heat, vaporize and pyrolyze the oil mist and obtain an oil and gas and a solid heat carrier to be regenerated, the pyrolysis reaction temperature is within a range of 480° C.-850° C.;

2) the oil and gas as well as the solid heat carrier to be regenerated flow rapidly and downward to a first rapid gas-solid separator 5-1 at the bottom of the downflow modification reaction tube 4 to carry out a gas-solid separation to obtain a coked solid heat carrier to be regenerated and a high temperature oil and gas;

3-1) the coked solid heat carrier to be regenerated flows through a first flow controller 7-1 and enters into a lower portion of a modification regeneration reactor 10 to conduct a regeneration reaction with a regeneration agent flowing from a regenerant inlet 9, the temperature of the regeneration reaction is within a range of 680° C.-1,250° C.; the regeneration gas and high temperature solid heat carrier produced by the regeneration reaction are subject to a gas-solid separation in a first gas-solid separator 1-1 on top of the modification regeneration reactor 10, then the high temperature solid heat carrier with a carrier/oil ratio of 1-14 passes through the first return controller 2-1 and flows into a top of the downflow modification reaction tube 4 and enter into the downflow modification reaction tube 4 so as to participate in circulation and cracking of the heavy oil, the regeneration gas from the first gas-solid separator 1-1 is subject to heat exchange with a heat exchanger 11 and then output from a regeneration gas outlet 12;

3-2) the high temperature oil and gas from the first rapid gas-solid separator 5-1 is not condensed but directly flowing in the gaseous phase into a millisecond cracking reactor 8 and mixing with a regeneration cracking catalyst having a temperature of 600° C.-850° C. from a second return controller 2-2 to carry out a gaseous phase catalytic cracking reaction, the temperature of cracking reaction temperature is within a range of 530° C.-750° C., then a cracking gas and a cracking catalyst to be regenerated produced by the cracking reaction pass through a second rapid gas-solid separator 5-2 to carry out a gas-solid separation in milliseconds;

4-1) the cracking catalyst to be regenerated flows through a second flow controller 7-2 and enters a lower portion of the crack regeneration reactor 13 for performing a regeneration reaction with air flowing from an air inlet 14, the temperature of the regeneration reaction is 630° C.-900° C., the obtained flue gas and the high temperature crack catalyst are subject to a gas-solid separation in a second gas-solid separator 1-2 at the top of the crack regeneration reactor 13; the high temperature crack catalyst with a catalyst/oil ratio of 1-8 passes through the second return controller 2-2 and flows into the millisecond cracking reactor 8 to participate the circulation reaction; while the flue gas is subject to heat exchange with a heat exchanger 11 and then output from a flue gas outlet 15;

4-2) the cracking oil and gas produced by the cracking reaction passes through a cracked oil and gas outlet 16 and enter into a catalytic fractionation tower 17 and is separated into different fraction products, which are cracked gas, gasoline fraction, diesel fraction, recycle oil and oil slurry;

5-1) the cracked gas flows through a olefin separation tower group 18 and is separated to obtain low-carbon olefins such as "ethylene, propylene and butene", and the stream of low-carbon olefins is output as the product from a low-carbon olefin outlet 19;

5-2) the gasoline fraction is extracted and separated by an aromatic hydrocarbon extraction tower group 20 to obtain low-carbon aromatic hydrocarbons such as "benzene, toluene and xylene", which are output as the product from a low-carbon aromatic hydrocarbon outlet 21, and obtain a gasoline fraction raffinate oil;

5-3) the diesel fraction flowing out from a diesel fraction outlet 23 is mixed with the recycle oil flowing from a recycle oil outlet 24 and the oil slurry flowing from an oil slurry outlet 25 to produce a hydrogenated modified oil by catalytic saturation or open-ring reaction with a hydrogenation catalyst in a hydrogenation reactor 26, then the produced hydrogenated modified oil flows from a hydrogenated modified oil outlet 27 and mixes with the gasoline fraction raffinate oil flowing from a hydrogenated modified oil outlet 22 and the mixture passes through a return oil line 28 and returns to a crude oil pipeline, and mixes with the crude oil and the mixture is used as a raw material which enters the upper portion of the downflow modification reaction tube 4 for performing pyrolysis modification.

In the following examples and comparative examples, both of the first and second gas-solid separators use a vertical cyclone; both of the vertical gas-solid separators 5 use a horizontal cyclone separator;

both the regeneration reactor and the crack regeneration reactor are riser regenerators;

the millisecond cracking reactor is a downflow tube reactor.

Example 1

The crude oil treated in the example is the thickened oil from the Shengli Oil Field in China with a residual carbon content of 15%. The key property parameters are shown in Table 1:

TABLE 1

| | |
|---|---|
| Density (kg/m$^3$, 20° C.) | 1,012.8 |
| Viscosity (mm · s$^{-1}$, 100° C.) | 471 |
| Residual carbon content (wt. %) | 15.0 |
| Carbon content (wt. %) | 85.6 |
| Hydrogen content (wt. %) | 7.4 |

The solid heat carrier is a calcium aluminate porous microspheres having a particle size ranging from 15 to 150 micrometers.

The cracking catalyst is ZSM-5 molecular sieve with a particle size ranging from 15 to 150 microns.

The hydrogenation catalyst is a composite of a nickel-based hydrogenation catalyst and a molecular sieve catalyst with a mass ratio of 2:1.

The process flow is as follows:

1) the thickened oil from the Shengli Oil Field preheated to 180° C. is sprayed from a feed inlet of a downflow modification reaction tube into an upper portion of the downflow modification reaction tube, the produced oil mist is mixed with a high temperature solid heat carrier (calcium aluminate porous microspheres) at a temperature 930° C. flowing downward from the first return controller for milliseconds, so as to heat, vaporize and pyrolyze the heavy oil, the pyrolysis reaction temperature is 505° C.;

2) the oil and gas as well as the solid heat carrier to be regenerated flow rapidly and downward to a first rapid gas-solid separator at the bottom of the downflow modification reaction tube to carry out a gas-solid separation;

3-1) the coked solid heat carrier to be regenerated enters into a modification regeneration reactor to conduct a regeneration reaction with air at the temperature of 960° C.; the regeneration gas and high temperature solid heat carrier produced by the regeneration reaction are subject to a gas-solid separation, then the high temperature solid heat carrier with a carrier/oil ratio of 9 returns to the downflow modification reaction tube so as to participate in circulation and cracking of the heavy oil, while the regeneration gas is subject to heat exchange and then output;

3-2) the high temperature oil and gas in the downflow modification reaction tube is not condensed but directly flowing in the gaseous phase into the millisecond cracking reactor and mixing with the regeneration cracking catalyst (ZSM-5 catalyst) having a temperature of 810° C. to carry out a gas phase catalytic cracking reaction, the temperature of cracking reaction temperature is 720° C., then the cracking gas and the cracking catalyst to be regenerated are subject to gas-solid separation in milliseconds;

4-1) the cracking catalyst to be regenerated enters into the crack regeneration reactor for performing a regeneration reaction with air at the temperature of 720° C., the obtained flue gas and the high temperature crack catalyst are subject to a gas-solid separation; then the high temperature crack catalyst with a catalyst/oil ratio of 7 returns to the millisecond cracking reactor to participate the circulation reaction; while the flue gas is subject to heat exchange and then output;

4-2) the cracking oil and gas produced by the cracking reaction is separated to obtain cracked gas, gasoline fraction, diesel fraction, recycle oil and oil slurry, respectively;

5-1) the cracked gas is separated for producing low-carbon olefins such as "ethylene, propylene and butene", which are output as products from a low-carbon olefin outlet;

5-2) the gasoline fraction is extracted and separated to obtain low-carbon aromatic hydrocarbons such as "benzene, toluene and xylene", which are output as products from a low-carbon aromatic hydrocarbon outlet, and a gasoline fraction raffinate oil;

5-3) the diesel fraction is mixed with the recycle oil and the oil slurry to produce a hydrogenated modified oil by catalytic saturation or open-ring reaction with the hydrogenation catalyst in a hydrogenation reactor (the hydrogenation reaction temperature is 380° C. and the pressure is 8.5 MPa), then the produced hydrogenated modified oil mixes with the gasoline fraction raffinate oil and the mixture passes through a return oil line and returns to mix with the thickened oil and the mixture is used as a raw material which enters the upper portion of the downflow modification reaction tube for performing pyrolysis modification.

The result shows that the process of Example 1 has a total yield of three olefins (i.e., "ethylene, propylene and butane") up to 50% for the thickened oil from the Shengli Oil Field having a residual carbon content of 15%, wherein the yields of propylene and ethylene are 28% and 15%, respectively; and the yield of three aromatic hydrocarbons is 26%.

Comparative Example 1

This comparative example is used to illustrate the process of preparing olefins from the gaseous phase catalytic cracking of crude oil with multi-stages.

The crude oil processed in the comparative example is identical with that in Example 1.

The solid heat carrier is a calcium aluminate porous microspheres having a particle size ranging from 15 to 150 micrometers.

The cracking catalyst is ZSM-5 molecular sieve with a particle size ranging from 15 to 150 microns.

The process flow of preparing olefins from the gaseous phase catalytic cracking of the thickened oil from the Shengli Oil Field with multi-stages is as follows:

1) a high-efficiency atomizing nozzle sprays heavy oil preheated to 180° C. from a feed inlet of a downflow modification reaction tube into an upper portion of the downflow modification reaction tube, the produced oil mist is mixed with a high temperature solid heat carrier (calcium aluminate porous microspheres) at a temperature 930° C. flowing downward from the first return controller for milliseconds, so as to heat, vaporize and pyrolyze the oil mist, the pyrolysis reaction temperature is 505° C.;

2) the oil and gas as well as the solid heat carrier to be regenerated flow rapidly and downward to a rapid gas-solid separator at the bottom of the downflow modification reaction tube to carry out a gas-solid separation;

3-1) the coked solid heat carrier to be regenerated enters into a lower portion of a modification regeneration reactor to conduct a regeneration reaction with air at the temperature of 960° C.; the regeneration gas and high temperature solid heat carrier produced by the regeneration reaction are subject to a gas-solid separation, then the high temperature solid heat carrier with a carrier/oil ratio of 9 returns to the downflow modification reaction tube so as to participate in circulation and cracking of the heavy oil, while the regeneration gas is subject to heat exchange and then output;

3-2) the high temperature oil and gas in the downflow modification reaction tube are not condensed but directly flowing in the gaseous phase into the millisecond cracking reactor and mixing with the regeneration cracking catalyst (ZSM-5 catalyst) having a temperature of 810° C. to carry out a gas phase catalytic cracking reaction, the temperature of cracking reaction temperature is 720° C., then the cracking gas and the cracking catalyst to be regenerated are subject to gas-solid separation in milliseconds;

4-1) the cracking catalyst to be regenerated enters into the crack regeneration reactor for performing a regeneration reaction with air at the temperature of 720° C., the obtained flue gas and the high temperature crack catalyst are subject to a gas-solid separation; then the high temperature crack catalyst with a catalyst/oil ratio of 7 returns to the millisecond cracking reactor to participate the circulation reaction; while the flue gas is subject to heat exchange and then output;

4-2) the cracking oil and gas produced by the cracking reaction is separated to obtain cracked gas, gasoline fraction, diesel fraction, recycle oil and oil slurry, respectively;

5-1) the cracked gas is separated for producing low-carbon olefins such as "ethylene, propylene and butene", which are output as products from a low-carbon olefin outlet;

5-2) the gasoline fraction is extracted and separated to obtain low-carbon aromatic hydrocarbons such as "benzene, toluene and xylene" and a gasoline fraction raffinate oil, respectively;

5-3) the diesel fraction, recycle oil and oil slurry are directly mixed with the gasoline fraction raffinate oil, and then the mixture returns to mix with crude oil, the mixture is used as a raw material which enters the upper portion of the downflow modification reaction tube for performing pyrolysis modification.

The results show that in Comparative Example 1 a total yield of three olefins is 40%, wherein the yields of propylene and ethylene are 22% and 12%, respectively; and the yield of three aromatic hydrocarbons is 18%.

It is demonstrated by comparing Example 1 with Comparative Example 1 that the process of the present invention may be used for producing three olefins with a higher yield, and the crude oil resources can be fully utilized for producing low-carbon olefins, thereby maximizing the chemical products dominated orientation in the petroleum refining.

Comparative Example 2

The thickened oil from the Shengli Oil Field is treated according to the process of Example 1, except that the pyrolysis temperature is controlled to be 1,000° C.

The results show that a total yield of three olefins (i.e., "ethylene, propylene and butane") is 44%, wherein the yields of propylene and ethylene are 19% and 21%, respectively; and the yield of three aromatic hydrocarbons is 15%.

Example 2

The crude oil treated in the example is the thin oil from the Shengli Oil Field. The key property parameters are shown in Table 2:

TABLE 2

| | |
|---|---|
| Density (kg/m$^3$, 20° C.) | 834.1 |
| Viscosity (mm · s$^{-1}$, 100° C.) | 56 |
| Residual carbon content (wt. %) | 3.2 |
| Carbon content (wt. %) | 82.6 |
| Hydrogen content (wt. %) | 9.1 |

The solid heat carrier is aluminum silicate porous microsphere having a particle size ranging from 15 to 150 micrometers.

The cracking catalyst is ZSM-5 molecular sieve having a particle size ranging from 15 to 150 microns.

The hydrogenation catalyst is identical with that in Example 1.

The process flow is as follows:

1) the thin oil from the Shengli Oil Field preheated to 150° C. is sprayed from a feed inlet of a downflow modification reaction tube into an upper portion of the downflow modification reaction tube, the produced oil mist is mixed with a high temperature solid heat carrier (aluminum silicate porous microspheres) at a temperature 1,000° C. flowing downward from the first return controller for milliseconds, so as to heat, vaporize and pyrolyze the thin oil, the pyrolysis reaction temperature is 480° C.;

2) the oil and gas as well as the solid heat carrier to be regenerated flow rapidly and downward to a first rapid gas-solid separator at the bottom of the downflow modification reaction tube to carry out a gas-solid separation;

3-1) the coked solid heat carrier to be regenerated enters into a lower portion of a modification regeneration reactor to conduct a regeneration reaction with air at the temperature of 920° C.; the regeneration gas and high temperature solid heat carrier produced by the regeneration reaction are subject to a gas-solid separation, then the high temperature solid heat carrier with a carrier/oil ratio of 5 returns to the downflow modification reaction tube so as to participate in circulation and cracking of the thin oil, the regeneration gas is subject to heat exchange and then output;

3-2) the high temperature oil and gas in the downflow modification reaction tube is not condensed but directly flowing in the gaseous phase into the millisecond cracking reactor and mixing with the regeneration cracking catalyst (ZSM-5 catalyst) having a temperature of 700° C. to carry out a gaseous phase catalytic cracking reaction, the temperature of cracking reaction temperature is 620° C., then the cracking gas and the cracking catalyst to be regenerated are subject to gas-solid separation in milliseconds;

4-1) the cracking catalyst to be regenerated enters into the crack regeneration reactor for performing a regeneration reaction with air at the temperature of 800° C., the obtained flue gas and the high temperature crack catalyst are subject to a gas-solid separation; then the high temperature crack catalyst with a catalyst/oil ratio of 4 returns to the millisecond cracking reactor to participate the circulation reaction; while the flue gas is subject to heat exchange and then output;

4-2) the cracking oil and gas produced by the cracking reaction is separated to obtain cracked gas, gasoline fraction, diesel fraction, recycle oil and oil slurry, respectively;

5-1) the cracked gas is separated for producing low-carbon olefins such as "ethylene, propylene and butene", which are output as products from a low-carbon olefin outlet, which are output as products from a low-carbon olefin outlet;

5-2) the gasoline fraction is extracted and separated to obtain low-carbon aromatic hydrocarbons such as "benzene, toluene and xylene", which are output as products from a low-carbon aromatic hydrocarbon outlet, and a gasoline fraction raffinate oil;

5-3) the diesel fraction is mixed with the recycle oil and the oil slurry to produce a hydrogenated modified oil by catalytic saturation or open-ring reaction with the hydrogenation catalyst in a hydrogenation reactor (the hydrogenation reaction temperature is 390° C. and the pressure is 6.5 MPa), then the produced hydrogenated modified oil mixes with the gasoline fraction raffinate oil and the mixture passes through a return oil line and returns to mix with the thin oil and the mixture is used as a raw material which enters the upper portion of the downflow modification reaction tube for performing pyrolysis modification.

The result shows that the process of Example 2 has a total yield of three olefins (i.e., "ethylene, propylene and butane") as high as 55% for the thin oil from the Shengli Oil Field having a residual carbon content of 3.2%, wherein the yields of propylene and ethylene are 32% and 16%, respectively; and the yield of three aromatic hydrocarbons is 22%.

Comparative Example 3

The thin oil from the Shengli Oil Field is treated according to the process of Example 2, except that the high temperature solid heat carrier with a catalyst/oil ratio of 16 is controlled to pass through the first return controller and flow into a top of the downflow modification reaction tube and enter into the reaction tube to participate circulation and cracking of the thin oil.

The result reveals that a total yield of three olefins (i.e., "ethylene, propylene and butane") is 42%, wherein the yields of propylene and ethylene are 18% and 20%, respectively; and the yield of three aromatic hydrocarbons is 15%.

Comparative Example 4

The thin oil from the Shengli Oil Field is treated according to the process of Example 2, except that the high temperature solid heat carrier with a catalyst/oil ratio of 0.7 is controlled to pass through the first return controller and flow into a top of the downflow modification reaction tube and enter into the reaction tube to participate circulation and cracking of the thin oil.

The result reveals that a total yield of three olefins (i.e., "ethylene, propylene and butane") is 32%, wherein the yields of propylene and ethylene are 15% and 14%, respectively; and the yield of three aromatic hydrocarbons is only 13%.

Example 3

The crude oil processed in the example is identical with that in Example 1.

The solid heat carrier is the porous microsphere carrier loaded with alkali metal (Na), the porous microsphere carrier has a particle size ranging from 15 to 150 micrometers.

The cracking catalyst is a FCC molecular sieve catalyst having a particle size ranging from 15 to 150 micrometers.

The hydrogenation catalyst is identical with that in Example 1.

The process flow is as follows:

1) the thickened oil from the Shengli Oil Field preheated to 300° C. is sprayed from a feed inlet of a downflow modification reaction tube into an upper portion of the downflow modification reaction tube 4, the produced oil mist is mixed with a high temperature solid heat carrier (porous microsphere carrier loaded with Na) at a temperature 800° C. flowing downward from the first return controller for milliseconds, so as to heat, vaporize and pyrolyze the heavy oil, the pyrolysis reaction temperature is 660° C.;

2) the oil and gas as well as the solid heat carrier to be regenerated flow rapidly and downward to a first rapid gas-solid separator at the bottom of the downflow modification reaction tube to carry out a gas-solid separation;

3-1) the coked solid heat carrier to be regenerated enters into a modification regeneration reactor to conduct a regeneration reaction with air at the temperature of 900° C.; the regeneration gas and high temperature solid heat carrier produced by the regeneration reaction are subject to a gas-solid separation then the high temperature solid heat carrier with a carrier/oil ratio of 11 returns to the downflow modification reaction tube so as to participate in circulation and cracking of the heavy oil, the regeneration gas is subject to heat exchange and then output;

3-2) the high temperature oil and gas in the downflow modification reaction tube is not condensed but directly flowing in the gaseous phase into the millisecond cracking reactor and mixing with the regeneration cracking catalyst (FCC molecular sieve) having a temperature of 700° C. to carry out a gas phase catalytic cracking reaction, the temperature of cracking reaction temperature is 720° C., then the cracking gas and the cracking catalyst to be regenerated are subject to gas-solid separation in milliseconds;

4-1) the cracking catalyst to be regenerated enters into the crack regeneration reactor for performing a regeneration reaction with air at the temperature of 830° C., the obtained flue gas and the high temperature crack catalyst are subject to a gas-solid separation; then the high temperature crack catalyst with a catalyst/oil ratio of 2 returns to the millisecond cracking reactor to participate the circulation reaction; while the flue gas is subject to heat exchange and then output.

4-2) the cracking oil and gas produced by the cracking reaction is separated to obtain cracked gas, gasoline fraction, diesel fraction, recycle oil and oil slurry, respectively;

5-1) the cracked gas is separated for producing low-carbon olefins such as "ethylene, propylene and butene", which are output as products from a low-carbon olefin outlet;

5-2) the gasoline fraction is extracted and separated to obtain low-carbon aromatic hydrocarbons such as "benzene, toluene and xylene", which are output as products from a low-carbon aromatic hydrocarbon outlet, and a gasoline fraction raffinate oil;

5-3) the diesel fraction is mixed with the recycle oil and the oil slurry to produce a hydrogenated modified oil by catalytic saturation or open-ring reaction with the hydrogenation catalyst in a hydrogenation reactor (the hydrogenation reaction temperature is 380° C. and the pressure is 8.5 MPa), then the produced hydrogenated modified oil mixes with the gasoline fraction raffinate oil and the mixture passes through a return oil line and returns to mix with the thickened oil and the mixture is used as a raw material which enters the upper portion of the downflow modification reaction tube for performing pyrolysis modification.

The result shows that the process of Example 3 has a total yield of three olefins (i.e., "ethylene, propylene and butane") up to 52% for the crude oil, wherein the yields of propylene and ethylene are 25% and 19%, respectively; and the yield of three aromatic hydrocarbons is 20%.

The invention claimed is:

1. A process of maximizing production of chemical raw materials by gaseous phase catalytic cracking crude oil with multi-stages in milliseconds in combination with hydrogenation, the process comprising:

1) spraying crude oil, or a crude oil mix, preheated to 150° C.-350° C. with an atomizing nozzle, producing an oil mist, from a feed inlet of a downflow modification reaction tube into an upper portion of the downflow modification reaction tube, mixing the oil mist with a solid heat carrier at a temperature ranging from 650° C.-1,200° C. flowing downward from a first return controller for milliseconds, so as to heat, vaporize and pyrolyze the oil mist and obtain an oil and gas, and a solid heat carrier to be regenerated, wherein the pyrolysis reaction temperature is within a range of 480° C.–850° C. and the downflow modification reaction tube comprises a top and a bottom;

2) carrying out a gas-solid separation by allowing the oil and gas as well as the solid heat carrier to be regenerated to flow rapidly and downward to a first gas-solid separator at the bottom of the downflow modification reaction tube to carry out the gas-solid separation to obtain a coked solid heat carrier to be regenerated and a separated oil and gas;

3-1) allowing the coked solid heat carrier to be regenerated to flow through a first flow controller and enter into a lower portion of a modification regeneration reactor to conduct a regeneration reaction with a regeneration agent and produce a regeneration gas and a regenerated solid heat carrier, the temperature of the regeneration reaction within a range of 680° C.-1,250° C.; then subjecting the regeneration gas and the separated solid heat carrier to a gas-solid separation in a second gas-solid separator on top of the modification regeneration reactor to produce a regenerated solid heat carrier with a carrier/oil ratio of 1-14, then recirculating the regenerated solid heat carrier with a carrier/oil ratio of 1-14 through the first return controller, into the top of the downflow modification reaction tube, and into the downflow modification reaction tube so as to participate in the heating, vaporizing, and pyrolyzing of the oil mist; and subjecting the regeneration gas, after the second gas-solid separator on top of the modification regeneration reactor, to heat exchange and then output;

3-2) allowing the separated oil and gas, which is not condensed, from the first gas-solid separator to directly flow in the gaseous phase into a millisecond cracking reactor, and mix with a regeneration cracking catalyst having a temperature of 600° C.-850° C. to carry out a gaseous phase catalytic cracking reaction producing a cracking oil and gas and a cracking catalyst to be regenerated, the temperature of the gaseous phase catalytic cracking reaction is within a range of 530° C.–750° C., then subjecting the cracking oil and gas and a cracking catalyst to be regenerated to gas-solid separation in milliseconds;

4-1) allowing the cracking catalyst to be regenerated to flow through a second flow controller and enter a lower portion of a crack regeneration reactor for performing a regeneration reaction with air to produce a regenerated crack catalyst, the temperature of the regeneration reaction is 630° C.-900° C., subjecting a flue gas and the regenerated crack catalyst to a gas-solid separation in a third gas-solid separator at the top of the crack regeneration reactor to produce a crack catalyst with a catalyst/oil ratio of 1-8; passing the crack catalyst with a catalyst/oil ratio of 1-8 through a second return controller and into the millisecond cracking reactor to participate in the gaseous phase catalytic cracking reaction, and subjecting the flue gas to heat exchange and then output;

4-2) passing the cracking oil and gas into a catalytic fractionation tower and separating the cracking oil and gas in the catalytic fractionation tower into different fraction products, which are cracked gas, gasoline fraction, diesel fraction, recycle oil and oil slurry;

5-1) separating the cracked gas to obtain low-carbon olefins, 5-2) extracting and separating the gasoline fraction to obtain low-carbon aromatic hydrocarbons and a gasoline fraction raffinate oil;

5-3) mixing the diesel fraction with the recycle oil and the oil slurry to carry out catalytic saturation or open-ring reaction with a hydrogenation catalyst to obtain a hydrogenated modified oil, mixing the hydrogenated modified oil with the gasoline fraction raffinate oil to obtain a mixture, and returning the mixture to mix with the crude oil to form the crude oil mix, which enters the upper portion of the downflow modification reaction tube for mixing with at least one of the solid heat carrier or the regenerated solid heat carrier with a carrier/oil ratio of 1-14.

2. The process of maximizing production of chemical raw materials by gaseous phase catalytic cracking crude oil with multi-stages in milliseconds in combination with hydrogenation according to claim 1, wherein the crude oil is one of heavy oil, coal tar, shale oil and oil sand bitumen.

3. The process of maximizing production of chemical raw materials by gaseous phase catalytic cracking crude oil with multi-stages in milliseconds in combination with hydrogenation according to claim 1, wherein the regeneration agent is an oxidizing agent or a mixture of an oxidizing agent and water vapor, wherein the oxidizing agent is one of oxygen, air and oxygen-enriched air; and the regeneration gas is syngas or flue gas.

4. The process of maximizing production of chemical raw materials by gaseous phase catalytic cracking crude oil with multi-stages in milliseconds in combination with hydrogenation according to claim 1, wherein the solid heat carrier is at least one of semi-coke microspheres, calcium aluminate porous microspheres, magnesium aluminate spinel porous microspheres, aluminum silicate porous microspheres, calcium silicate porous microspheres, magnesium silicate porous microspheres, porous microsphere carriers loaded with alkali metals and alkaline-earths metal.

5. The process of maximizing production of chemical raw materials by gaseous phase catalytic cracking crude oil with multi-stages in milliseconds in combination with hydrogenation according to claim 1, wherein the second gas-solid separator and the third gas-solid separator are independently selected from the group consisting of an inertial separator, a horizontal cyclone separator and a vertical cyclone.

6. The process of maximizing production of chemical raw materials by gaseous phase catalytic cracking crude oil with multi-stages in milliseconds in combination with hydrogenation according to claim 1, wherein the cracking catalyst is at least one selected from a group consisting of a FCC molecular sieve catalyst, a shape selective molecular sieve catalyst and an alkaline solid porous catalyst.

7. The process of maximizing production of chemical raw materials by gaseous phase catalytic cracking crude oil with multi-stages in milliseconds in combination with hydrogenation according to claim 1, wherein the modification regeneration reactor is one selected from a group consisting of a riser regenerator, a turbulent fluidized bed regenerator and a bubbling fluidized bed regenerator.

8. The process of maximizing production of chemical raw materials by gaseous phase catalytic cracking crude oil with multi-stages in milliseconds in combination with hydrogenation according to claim 1, wherein the millisecond cracking reactor is one selected from a group consisting of a downflow tube reactor, a horizontal inertia rotary separation reactor and a cross-staggered short contact reactor.

9. The process of maximizing production of chemical raw materials by gaseous phase catalytic cracking crude oil with multi-stages in milliseconds in combination with hydrogenation according to claim 1, wherein the hydrogenation catalyst is a composite catalyst of a nickel-based hydrogenation catalyst and a molecular sieve catalyst.

10. The process of maximizing production of chemical raw materials by gaseous phase catalytic cracking crude oil with multi-stages in milliseconds in combination with hydrogenation according to claim 1, wherein the step of subjecting the cracking oil and gas and cracking catalyst to be regenerated to gas-solid separation in milliseconds comprises passing the cracking oil and gas and cracking catalyst to be regenerated through a fourth gas-solid separator, the first gas-solid separator and the fourth gas-solid separator are independently selected from the group consisting of an inertial separator, a horizontal cyclone separator and a vertical cyclone.

11. The process of maximizing production of chemical raw materials by gaseous phase catalytic cracking crude oil with multi-stages in milliseconds in combination with hydrogenation according to claim 1, wherein the crack regeneration reactor is one selected from a group consisting of a riser regenerator, a turbulent fluidized bed regenerator and a bubbling fluidized bed regenerator.

12. The process of maximizing production of chemical raw materials by gaseous phase catalytic cracking crude oil with multi-stages in milliseconds in combination with hydrogenation according to claim 1, wherein the low-carbon olefins in step 5-1) comprise at least one selected from the group consisting of ethylene, propylene and butane.

13. The process of maximizing production of chemical raw materials by gaseous phase catalytic cracking crude oil with multi-stages in milliseconds in combination with hydrogenation according to claim 1, wherein the low-carbon aromatic hydrocarbons of step 5-2) comprise at least one selected from the group consisting of benzene, toluene and xylene.

* * * * *